US005743668A

United States Patent [19]

Zimmerman

[11] Patent Number: 5,743,668

[45] Date of Patent: Apr. 28, 1998

[54] ADJUSTABLE TIP CAULKING TUBE

[76] Inventor: Leonard Zimmerman, 280 Union Hill Rd., Manalapan, N.J. 07726

[21] Appl. No.: 695,106

[22] Filed: Aug. 8, 1996

[51] Int. Cl.[6] ..... B05C 17/01; B05B 1/30; B65D 47/22

[52] U.S. Cl. ..... 401/265; 401/263; 401/179; 401/5; 239/533.13; 222/502; 222/326; 222/544

[58] Field of Search ..... 401/263, 265, 401/266, 179, 176, 5; 239/601, 602, 533.13, 579, 580; 222/566, 326, 327, 544, 502

[56] References Cited

U.S. PATENT DOCUMENTS

| | | | |
|---|---|---|---|
| 1,865,012 | 6/1932 | Jackson | 239/602 X |
| 2,004,407 | 6/1935 | Hemb | 222/544 X |
| 2,309,895 | 2/1943 | Griffith | 401/263 X |
| 2,783,094 | 2/1957 | Storie | 239/602 X |
| 2,901,152 | 8/1959 | Wahnsiedler | 401/263 X |
| 5,011,084 | 4/1991 | Toland | 239/602 |

FOREIGN PATENT DOCUMENTS

| | | | |
|---|---|---|---|
| 411831 | 4/1925 | Germany | 401/263 |

*Primary Examiner*—Danton D. DeMille

[57] ABSTRACT

An adjustable tip caulking tube including a tapered nozzle having an open inner end and an open outer end. The open inner end has a diameter greater than a diameter of the open outer end. The open inner end couples with an opening in a front end of a caulking tube. A dial couples with the tapered nozzle whereby movement of the dial away from the open outer end will reduce the diameter thereof.

1 Claim, 3 Drawing Sheets

ADJUSTABLE TIP CAULKING TUBE

BACKGROUND OF THE INVENTION

1. Field of the Invention

The present invention relates to an adjustable tip caulking tube and more particularly pertains to filling areas of differing widths with caulk with an adjustable tip caulking tube.

2. Description of the Prior Art

The use of caulking tips is known in the prior art. More specifically, caulking tips heretofore devised and utilized for the purpose of distributing caulk are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,104,013 to Hawley discloses a caulking tube nozzle adaptor adjustable for different caulk bead sizes.

U.S. Pat. No. 4,380,425 to Edelman discloses a caulking spout.

U.S. Pat. No. Des. 333,955 to Hatgas et al. discloses the ornamental design for a tip for a dispenser of caulking, adhesive or sealant.

U.S. Pat. No. 5,249,876 to Hattman discloses a caulking nozzle.

U.S. Pat. No. 4,957,225 to Childers discloses a replaceable caulking tip for use on caulking cartridges and method of manufacture.

U.S. Pat. No. 4,878,599 to Greenway discloses a caulking nozzle.

While these devices fulfill their respective, particular objective and requirements, the aforementioned patents do not describe an adjustable tip caulking tube for filling areas of differing widths with caulk.

In this respect, the adjustable tip caulking tube according to the present invention substantially departs from the conventional concepts and designs of the prior art, and in doing so provides an apparatus primarily developed for the purpose of filling areas of differing widths with caulk.

Therefore, it can be appreciated that there exists a continuing need for new and improved adjustable tip caulking tube which can be used for filling areas of differing widths with caulk. In this regard, the present invention substantially fulfills this need.

SUMMARY OF THE INVENTION

In the view of the foregoing disadvantages inherent in the known types of caulking tips now present in the prior art, the present invention provides an improved adjustable tip caulking tube. As such, the general purpose of the present invention, which will be described subsequently in greater detail, is to provide a new and improved adjustable tip caulking tube and method which has all the advantages of the prior art and none of the disadvantages.

To attain this, the present invention essentially comprises a tube having a generally elongated and cylindrical configuration. The tube is adapted to contain a caulking material. The tube has an opening in a front end thereof. The tube is dimensioned for securement to a caulking gun. The device includes a tapered nozzle having an open inner end and an open outer end. The open inner end has a diameter greater than a diameter of the open outer end. The open inner end couples with the opening in the front end of the tube for receiving caulking material therein. The tapered nozzle has an interior surface and an exterior surface. The interior surface has a plurality of concentric springs disposed thereon for biasing the open outer end in a fully open orientation. The exterior surface has an angularly disposed elongated ridge thereon. The device includes a dial having an annular configuration. The dial has a recess formed on an interior surface thereof. The dial couples with the tapered nozzle with the recess slidably coupling with the ridge whereby movement of the dial away from the open outer end will reduce the diameter thereof.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved adjustable tip caulking tube which has all the advantages of the prior art caulking tips and none of the disadvantages.

It is another object of the present invention to provide a new and improved adjustable tip caulking tube which may be easily and efficiently manufactured and marketed.

It is a further object of the present invention to provide a new and improved adjustable tip caulking tube which is of durable and reliable construction.

An even further object of the present invention is to provide a new and improved adjustable tip caulking tube which is susceptible of a low cost of manufacture with regard to both materials and labor, and which accordingly is then susceptible of low prices of sale to the consuming public, thereby making such an adjustable tip caulking tube economically available to the buying public.

Even still another object of the present invention is to provide a new and improved adjustable tip caulking tube for filling areas of differing widths with caulk.

Lastly, it is an object of the present invention to provide a new and improved adjustable tip caulking tube including a tapered nozzle having an open inner end and an open outer end. The open inner end has a diameter greater than a diameter of the open outer end. The open inner end couples with an opening in a front end of a caulking tube. A dial couples with the tapered nozzle whereby movement of the dial away from the open outer end will reduce the diameter thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
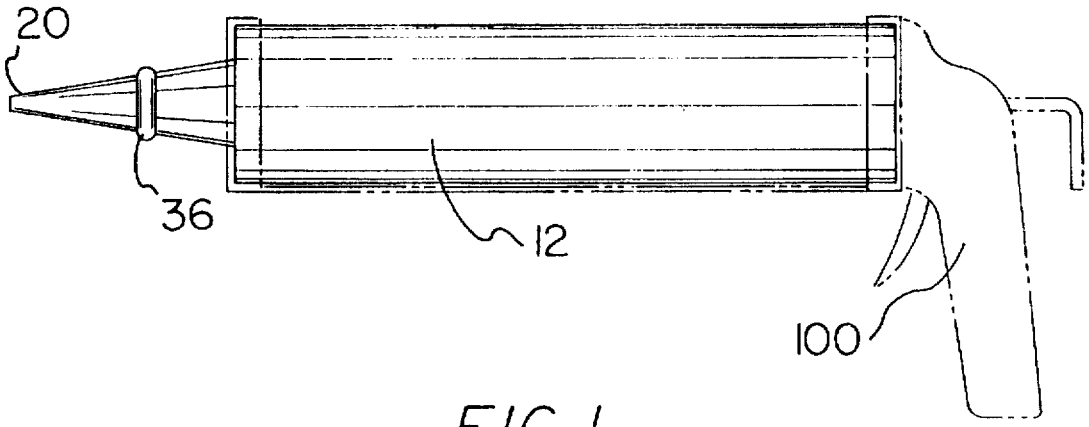
FIG. 1 is a side view of the present invention secured to a caulking gun.
Figure 2:
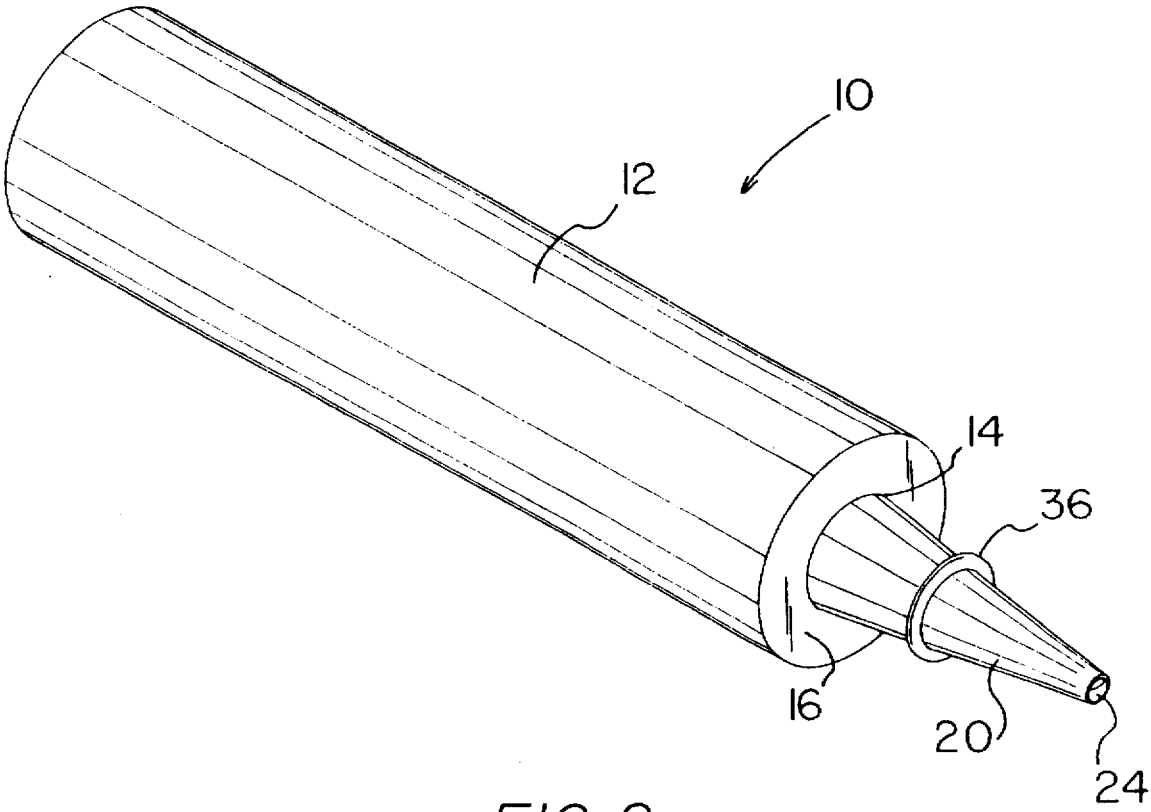
FIG. 2 is a perspective view of the present invention.

With reference now to the drawings, and in particular, to FIGS. 1–6 thereof, the preferred embodiment of the new and improved adjustable tip caulking tube embodying the principles and concepts of the present invention and generally designated by the reference number 10 will be described.

Specifically, it will be noted in the various Figures that the device relates to an adjustable tip caulking tube for filling areas of differing widths with caulk. In its broadest context, the device consists of a tube, a tapered nozzle and a dial. Such components are individually configured and correlated with respect to each other so as to attain the desired objective.

The device 10 includes a tube 12 having a generally elongated and cylindrical configuration. The tube 12 is adapted to contain a caulking material. The tube 12 has an opening 14 in a front end 16 thereof. The tube 12 is dimensioned for securement to a caulking gun 100.

Figure 3:
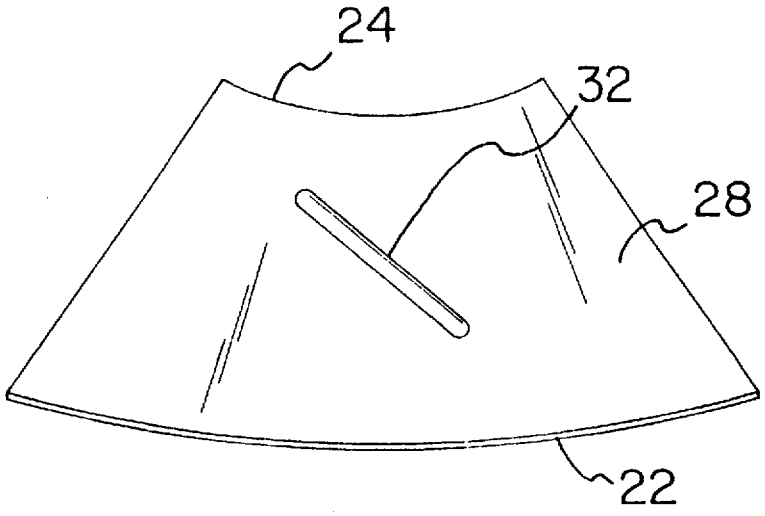
FIG. 3 is an illustration of an exterior of the unraveled nozzle of the present invention.
Figure 4:
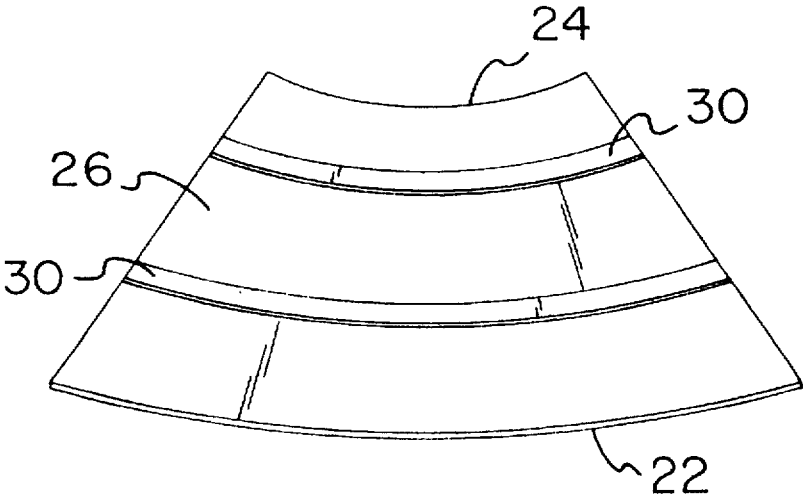
FIG. 4 is a plan view of an interior of the nozzle of the present invention.
Figure 5:
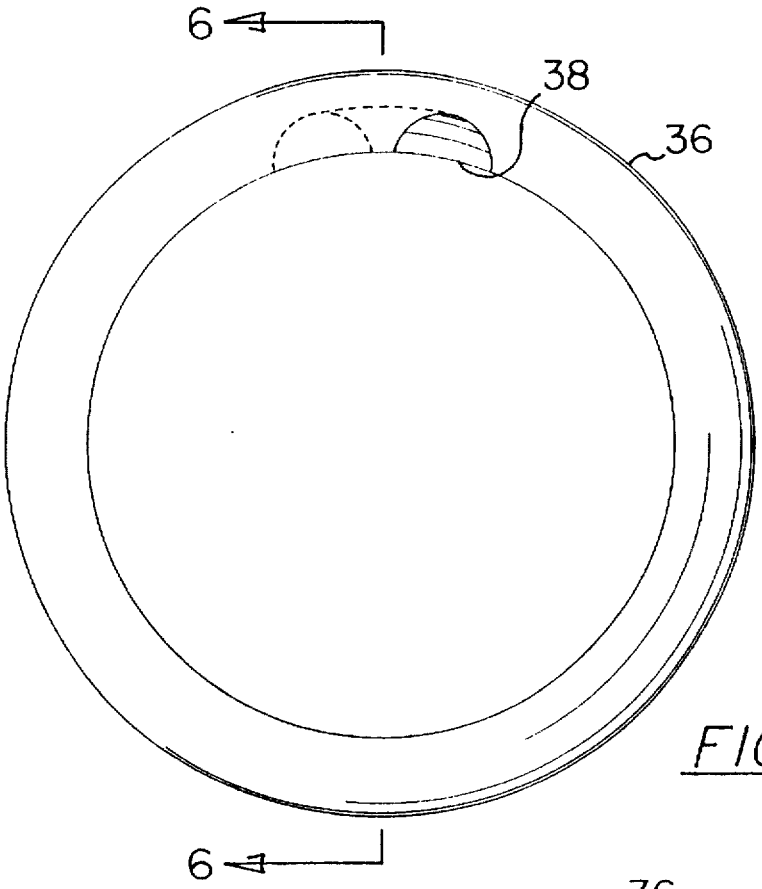
FIG. 5 is a front elevation view of the dial of the present invention.
Figure 6:
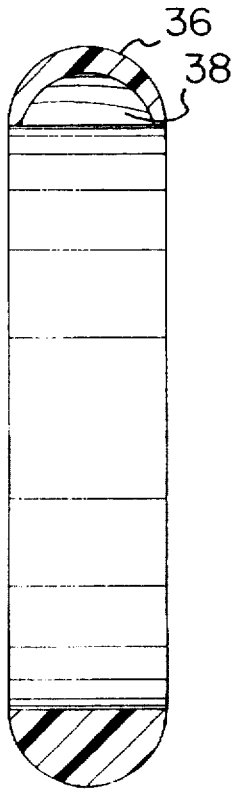
FIG. 6 is a cross-sectional view as taken along line 6—6 of FIG. 5.

The device 10 includes a tapered nozzle 20 having an open inner end 22 and an open outer end 24. The open inner end 22 has a diameter greater than a diameter of the open outer end 24. The open inner end 22 couples with the opening 14 in the front end 16 of the tube 12 for receiving caulking material therein. The tapered nozzle 20 has an interior surface 26 and an exterior surface 28. FIGS. 3 and 4. The interior surface 26 has a plurality of concentric springs 30 disposed thereon for biasing the open outer end 24 in a fully open orientation. The exterior surface 28 has an angularly disposed elongated ridge 32 thereon. The ridge 32 is of a length greater than half of a length of the tapered nozzle 20.

Lastly, the device 10 includes a dial 36 having an annular configuration. The dial 36 has a recess 38 formed on an interior surface thereof. The dial 36 couples with the tapered nozzle 20 with the recess 38 slidably coupling with the ridge 32 whereby movement of the dial 36 away from the open outer end 24 will reduce the diameter thereof. This will reduce the size of the caulk bead that will dispense through the tapered nozzle 20. Moving the dial 36 away from the tube 12 will cause the concentric springs 30 to return the open outer end 24 to a normal orientation and diameter.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. An adjustable tip caulking tube for filling areas of differing widths with caulk comprising, in combination:

a tube having a generally elongated and cylindrical configuration, the tube adapted to contain a caulking material, the tube having an opening in a front end thereof, the tube being dimensioned for securement to a caulking gun;

a tapered nozzle having an open inner end and an open outer end, the open inner end having a diameter greater than a diameter of the open outer end, the open inner end coupling with the opening in the front end of the tube for receiving caulking material therein, the tapered nozzle having an interior surface and an exterior surface, the interior surface having a plurality of concentric springs disposed thereon for biasing the open outer end in a fully open orientation, the exterior surface having an angularly disposed elongated ridge thereon;

a dial having an annular configuration, the dial having a recess formed on an interior surface thereof, the dial coupling with the tapered nozzle with the recess slidably coupling with the ridge whereby movement of the dial away from the open outer end will reduce the diameter thereof.

* * * * *